US006715221B1

(12) United States Patent
Sasaki

(10) Patent No.: US 6,715,221 B1
(45) Date of Patent: Apr. 6, 2004

(54) FOOT STIMULATING SHOE INSOLE

(75) Inventor: Manhachi Sasaki, Saeki-gun (JP)

(73) Assignee: Tech Corporation Co., Ltd., Hiroshima (JP)

( * ) Notice: Subject to any disclaimer, the term of this patent is extended or adjusted under 35 U.S.C. 154(b) by 0 days.

(21) Appl. No.: 10/313,260

(22) Filed: Dec. 6, 2002

(51) Int. Cl.[7] ..... A61F 5/14; A43B 7/08
(52) U.S. Cl. ..... 36/141; 36/3 B; 36/43
(58) Field of Search ..... 36/141, 3 B, 147, 36/43, 44, 11.5, 140

(56) References Cited

U.S. PATENT DOCUMENTS

| | | | | | |
|---|---|---|---|---|---|
| 2,030,545 | A | * | 2/1936 | Schulze | 36/3 B |
| 2,844,833 | A | * | 7/1958 | Odermatt | 36/3 B |
| 4,047,310 | A | * | 9/1977 | Sunoo | 36/11.5 |
| 4,345,387 | A | * | 8/1982 | Daswick | 36/43 |
| 4,598,484 | A | * | 7/1986 | Ma | 36/3 R |
| 5,551,173 | A | * | 9/1996 | Chambers | 36/44 |
| 5,860,229 | A | * | 1/1999 | Morgenstern | 36/141 |

FOREIGN PATENT DOCUMENTS

| | | | |
|---|---|---|---|
| CH | 661846 | * | 8/1987 |
| DE | 2619410 | * | 11/1976 |

* cited by examiner

*Primary Examiner*—Ted Kavanaugh
(74) *Attorney, Agent, or Firm*—Koda & Androlia

(57) ABSTRACT

A foot stimulating shoe insole including: an insole member of a somewhat soft material; a plurality of ventilation and fastening holes are opened in the insole member from the top surface to the bottom surface thereof; a plurality of ventilation-maintaining projecting portions that have a certain height and are disposed on the bottom surface of the insole member; and stimulating projecting elements disposed in the ventilation and fastening holes, each of the stimulating projecting elements having a stimulating part in its head part, a supporting shaft in its intermediate part, and a projecting anchoring part having an inverted truncated circular cone shape at its lower end. The stimulating parts have an inverted bowl shape and come in several types with different thicknesses. Also, the material of the insole member uses mugwort as a part of the material.

3 Claims, 2 Drawing Sheets

FOOT STIMULATING SHOE INSOLE

BACKGROUND OF THE INVENTION

1. Field of the Invention

The present invention relates to a foot stimulating shoe insole.

2. Prior Art

Conventionally, in cases where shoes are larger than the feet, shoe insoles are placed inside the shoes to adjust the size. In cases where the inside bottom portions of shoes have become soiled, such insoles are also placed inside the shoes in order to camouflage the inside bottoms so that the insides of the shoes appear clean to the eye.

Furthermore, nerves in various positions including internal organs of the human body, etc. known as "tsubo (or pressure point or energy center)" are respectively concentrated on the soles of the left and right feet in a symmetrical manner, and therapy can be performed by applying finger pressure ("acupressure") to these respective "tsubo" so that the sites are stimulated.

However, in order to perform such therapy, it is necessary to apply constant pressure to the soles of the feet with fingers of the hand. Thus, such therapy can only be performed when relaxing at home, etc.

SUMMARY OF THE INVENTION

Accordingly, the present invention is to eliminate the above-described drawbacks; and the present invention develops and provides a foot stimulating shoe insole which can perform acupressure on the soles of the feet while walking, which can maintain ventilation inside the shoes so as to be hygienic, and which allows detachable installation of acupressure elements in desired locations.

Here, as a means of solving the above-described problems, the present invention provides a foot stimulating shoe insole in which: a somewhat soft insole member is provided; countless small holes are formed in this insole member in a regular manner, these small holes being respectively formed so that the holes run straight through the insole member from the upper surface to the bottom surface; one or more acupressure pegs are disposed in the above-described small holes, each of acupressure pegs being made of a magnetic material and including a protruding head part, a supporting shaft which is formed in a straight orientation on this head part and which fits in the above-described small hole, and a projecting anchoring part which has an inverted truncated circular cone shape that is slightly larger in diameter than the above-described small hole. In this structure, the material of the insole member uses mugwort as a part of the raw material.

DETAILED DESCRIPTION OF THE INVENTION

Figure 1:
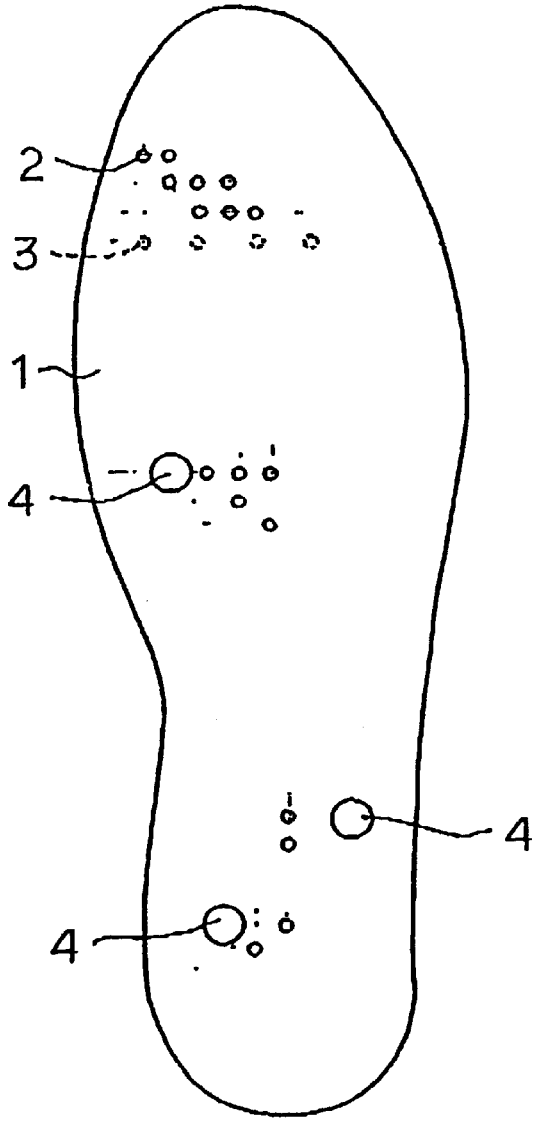
FIG. 1 is a top view showing one embodiment of the present invention.
Figure 2:
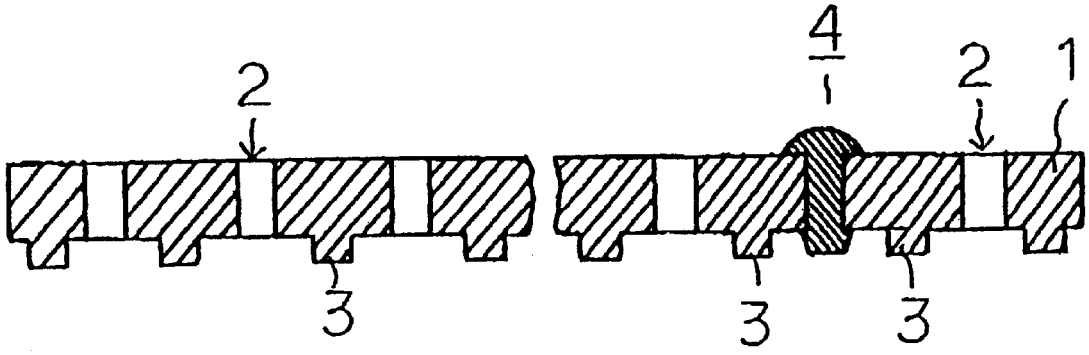
FIG. 2 is a partially cut-away enlarged sectional view showing one embodiment of the present invention.
Figure 3:
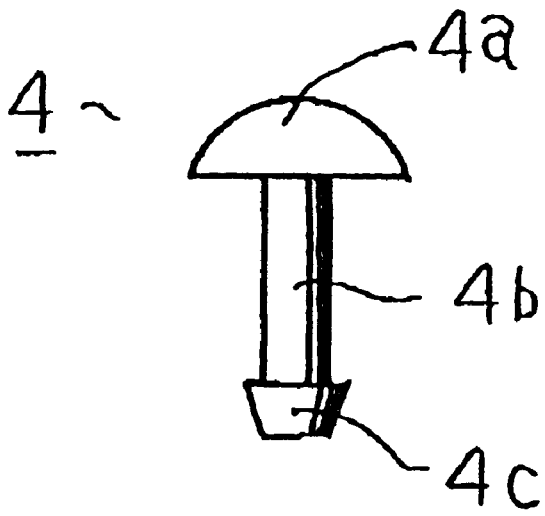
FIG. 3 is a front view showing one embodiment of the stimulating projecting elements used in the present invention.

Next, a preferred embodiment of the present invention will be described based on the drawings.

More specifically, the foot stimulating shoe insole of the present invention comprises: an insole member 1 formed from a somewhat soft material; a plurality of ventilation and fastening holes 2 which are opened through the insole member 1 from the top surface to the bottom surface are bored through this insole member 1; a plurality of ventilation-maintaining projecting portions 3 that have a certain height are disposed on the bottom surface of the insole member 1; and stimulating projecting elements 4, each of which has a stimulating part 4*a* in its head part, a supporting shaft 4*b* in its intermediate part, and a projecting anchoring part 4*c* having an inverted truncated circular cone shape at its lower end, are disposed in the ventilation and fastening holes 2.

Furthermore, the stimulating part 4*a* can have an inverted bowl shape and can be in several types with different thicknesses. Also, the material of the stimulating projecting elements 4 can be made of a magnetic material.

Furthermore, mugwort is used as a part of the raw material for the material of the insole 1. Accordingly, an anti-fungal effect is obtained. At the time of use, the stimulating projecting elements 4 are used with the projecting anchoring parts 4*c* thereof that have an inverted truncated circular cone inserted into the ventilation and fastening holes 2 of the insole member 1 in locations where acupressure is required.

The present invention is characterized by the fact that an insole member 1 formed from a somewhat soft material is disposed in the shoe insole; a plurality of ventilation and fastening holes 2 which are opened through the insole member 1 from the top surface to the bottom surface are bored through this insole member 1; a plurality of ventilation-maintaining projecting portions 3 that have a certain height are disposed on the bottom surface of the insole member 1; and stimulating projecting elements 4, each of which has a stimulating part 4*a* in its head part, a supporting shaft 4*b* in its intermediate part, and a projecting anchoring part 4*c* of an inverted truncated circular cone shape at its lower end, are disposed in the ventilation and fastening holes 2. Accordingly, the stimulating projecting elements 4 can be disposed in locations where it is desired to perform acupressure. Furthermore, the degree of acupressure can also be adjusted by mounting stimulating projecting elements 4 that have stimulating parts 4*a* of different thicknesses in locations of the insole member 1 where it is desired to apply acupressure.

Furthermore, the projecting anchoring parts 4*c* of the stimulating projecting elements 4 have an inverted truncated circular cone shape. These anchoring parts tend not to come loose after being mounted and can hold the stimulating projecting elements 4 in the locations of pressure points, so that acupressure can be applied to the "tsubo" of the feet by the weight of the wearer while the wearer is walking.

Furthermore, a plurality of ventilation-maintaining projecting portions 3 that have a certain height are disposed on the bottom surface of the insole member 1. These parts can maintain ventilation between the bottom of the shoe and the insole member 1. Furthermore, a plurality of ventilation and fastening holes 2 that are opened through the insole member 1 from the upper surface to the bottom surface of the insole member 1 are bored through the insole member 1, and these holes can maintain ventilation. Moreover, the head parts of the stimulating projecting elements 4 have an inverted bowl shape and are gradual projections that protrude from the insole member 1, so that an appropriate acupressure action can be applied to the soles of the feet. Furthermore, since mugwort is contained in the insole member 1 as a part of the raw material, an anti-fungal effect is obtained, so that the odor of perspiration inside the shoes, etc., can be prevented. The present invention offers these and other beneficial effects.

What is claimed is:

1. A foot stimulating shoe insole comprising:

an insole member formed from a soft material;

a plurality of ventilation and fastening holes provided in said insole member so as to pass through said insole member from a top surface to a bottom surface thereof;

a plurality of ventilation-maintaining projecting portions having a certain height provided on a bottom surface of said insole member; and stimulating projecting elements disposed in said ventilation and fastening holes, each of said stimulating projecting elements having a stimulating part at a head part thereof, a supporting shaft at an intermediate part thereof, and a projecting anchoring part with an inverted truncated circular cone shape at a lower end thereof.

2. The foot stimulating shoe insole according to claim 1, wherein said stimulating parts are shaped in an inverted bowl and have several types with different thicknesses.

3. The foot stimulating shoe insole according to claim 1, wherein a material of said insole member includes mugwort as part thereof.

* * * * *